United States Patent [19]

Lee

[11] Patent Number: 4,639,635

[45] Date of Patent: Jan. 27, 1987

[54] SPARK PLUG

[75] Inventor: Anthony J. J. Lee, Chelmsford, England

[73] Assignee: National Research Development Corporation, London, England

[21] Appl. No.: 619,163

[22] PCT Filed: Oct. 11, 1983

[86] PCT No.: PCT/GB83/00253

§ 371 Date: Jun. 7, 1984

§ 102(e) Date: Jun. 7, 1984

[87] PCT Pub. No.: WO84/01674

PCT Pub. Date: Apr. 26, 1984

[30] Foreign Application Priority Data

Oct. 11, 1982 [GB] United Kingdom ..... 8229009
Apr. 29, 1983 [GB] United Kingdom ..... 8311904

[51] Int. Cl.[4] ..... H01T 13/46

[52] U.S. Cl. ..... 313/123; 313/125; 313/128; 313/130; 313/143; 315/51

[58] Field of Search ..... 313/123, 125, 128, 130, 313/141, 143; 315/52, 51

[56] References Cited

U.S. PATENT DOCUMENTS

| | | | |
|---|---|---|---|
| 1,399,166 | 12/1921 | Springer . | |
| 2,543,961 | 3/1951 | Feichter | 313/123 |
| 3,567,987 | 3/1971 | Schnurmacher | 313/123 |
| 3,719,851 | 3/1973 | Burley | 313/123 |
| 3,908,145 | 9/1975 | Kubo | 313/123 |
| 4,275,328 | 6/1981 | Watanabe et al. | 313/123 |

FOREIGN PATENT DOCUMENTS

| | | | |
|---|---|---|---|
| 730688 | 1/1932 | France . | |
| 541097 | 6/1956 | Italy | 313/125 |
| 81/00885 | 4/1981 | World Int. Prop. O. . | |
| 104334 | 12/1917 | United Kingdom . | |
| 410873 | 5/1934 | United Kingdom . | |
| 434009 | 8/1935 | United Kingdom . | |

*Primary Examiner*—Palmer C. DeMeo
*Assistant Examiner*—M. Razavi
*Attorney, Agent, or Firm*—Shapiro and Shapiro

[57] ABSTRACT

The invention relates to a spark plug (1) comprising at least two insulated electrodes (5) and (6), an earthed electrode (7) and a chamber (4) so arranged with respect to one another that when a voltage is applied arcs are struck in series between electrodes (7) and (6) and (6) and (5) to provide a continuous plasma jet expelled from the chamber (4) at low energies (<100 mJ) and which can be used for combustion of a lean air/fuel mixture.

12 Claims, 10 Drawing Figures

SPARK PLUG

TECHNICAL FIELD OF INVENTION

The invention relates to a spark plug, particularly though not exclusively for use in an internal combustion engine.

BACKGROUND ART

In common spark plugs, combustion is initiated from a plasma generated by striking an arc between two electrodes. With typical spark energies of 30 to 40 mJ. these devices are not capable of igniting mixtures with an air/fuel ratio significantly greater than stoichiometric.

Published work indicates that a jet of plasma is much more efficient at igniting mixtures with a high air/fuel ratio (see, for example, SAE Technical Papers 770355 and 800042). In spark plugs designed to generate jets of plasma at a high air/fuel ratio, a high energy (>1 Joule) is required to be dissipated in the arc.

DISCLOSURE OF INVENTION

It is an object of the invention to seek to mitigate this disadvantage of prior plasma jet type spark plugs.

A spark plug according to the invention is characterized by at least two insulated electrodes and an earth electrode so arranged with respect to one another that arcs are struck in series between successive electrodes.

Spark plugs embodying the invention are hereinafter described, by way of example, with reference to the accompanying drawings.

BRIEF DESCRIPTION OF DRAWINGS

Referring to the drawings, FIG. 1 shows a spark plug in which combustion is initiated from a plasma generated by striking an arc between electrodes A and B. With typical spark energies of 30 to 40 mJ. such a plug is not capable of igniting mixtures with an air/fuel ratio significantly greater than stoichiometric. FIG. 2 shows a cross section of a relevant part of another proposed spark plug which can generate a plasma jet for igniting combustible mixtures with a high air/fuel ratio. An arc is struck between end electrode A and centre insulated electrode B, within cavity C in ceramic body D. Providing sufficient energy is dissipated in the arc (>1 Joule), a high level of ionization is produced in the cavity C. The energy dissipated also heats the gas, causing it to expand rapidly. Consequently, ionized gas is ejected from the cavity C as a plasma jet E.

Spark plugs embodying the invention are illustrated in FIGS. 3–9, in which like reference symbols are used for like parts.

Referring to FIG. 3 there is shown a spark plug 1 embodying the invention, which is essentially a twin gap spark plug for producing a plasma jet at E. The relevant, spark forming part of the spark plug 1 has an insulator in the form of a ceramic body 2 terminating at a surface 3, the insulator encompassing a cavity 4 in which there is a (central) insulated electrode 5. There is also an insulated electrode 6 and an earth electrode 7. The electrodes are spaced apart and form sequential pairs 7-6 and 6-5. More particularly, as will be appreciated from the drawing, electrode 5 is situated at the base of the cavity interior while electrode 6 is situated to one side of the cavity, with a portion of the electrode 6 adjacent the cavity orifice or exit. Ground electrode 7 is spaced across the cavity exit from electrode 6, as shown. Thus, electrodes 5 and 6 define a first spark gap across a portion of the cavity interior and electrodes 6 and 7 define a second spark gap across the cavity exit.

The spark plug 1 embodying the invention operates as follows:

Arcs are struck simultaneously between electrodes 7 and 6, and 6 and 5, the arcs being in series. The heat generated by the arc between electrodes 6 and 5 causes the gas in the cavity 4 to expand and be ejected from the cavity 4. As the expanding gas escapes from the cavity 4 it has to pass through the arc between the electrodes 7 and 6, and is in consequence ionized. Hence a jet of plasma is generated at E.

This system of plasma jet generation is very efficient and will work with spark energies of <100 mJ, for example in the range of about 50 mJ to 100 mJ.

The operation of the device is self-stabilizing as a consequence of negative feedback inherent in the design. The arcs 7-6, 6-5 are in series. Any tendency for the arc 7-6 to be extinguished by the expanding gas passing through it will reduce the arc current. This will also reduce the current through arc 6-5, hence reducing the heat dissipation within cavity 4. The gas will therefore expand more slowly, reducing the tendency to extinguish arc 7-6. Thus two spark gaps in series are used. One spark gap is inside the cavity to heat and expand the gas. The other is across the orifice of the cavity to ionize the expanding gas as it is ejected from the cavity. It is possible to generate a plasma jet with less than 100 mJ of energy.

Figure 1:
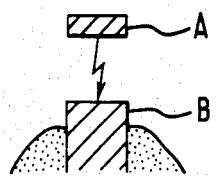
FIG.1. PRIOR ART
FIG. 1 is schematic longitudinal sectional view of one proposed or traditional spark plug.
Figure 2:
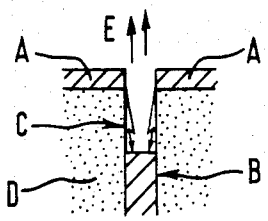
FIG.2. PRIOR ART
FIG. 2 is a schematic longitudinal sectional view of another proposed spark plug.
Figure 3:
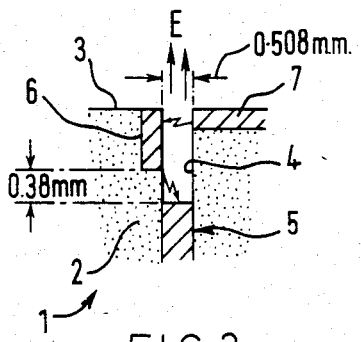
FIG. 3 is a schematic longitudinal sectional view of a spark plug according to the invention.
Figure 4:
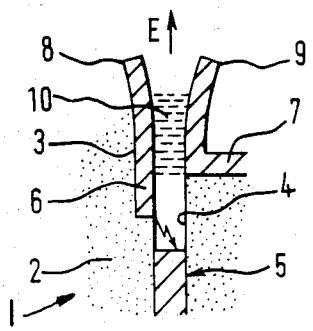
FIG. 4 is a schematic longitudinal sectional view of a second embodiment of spark plug according to the invention.

Referring now to FIG. 4, there is shown a longitudinal sectional view of a part of another spark plug 1, according to the invention, which can generate a plasma jet for igniting combustible mixtures with a high air/fuel ratio. The relevant, spark forming part of the spark plug 1 has an insulator in the form of a cermaic body 2 terminating at a surface 3, the insulator encompassing a cavity 4 in which there is a (central) insulated electrode 5. There is also an insulated electrode 6 and an earth electrode 7.

The electrodes 6 and 7 are each extended upwardly, as viewed, above or away from the surface 3 of the body 2. In the embodiment shown, the respective extensions 8 and 9 of the electrodes 6 and 7 diverge upwardly as viewed.

In use, arcs are struck simultaneously between electrodes 7 and 6, and 6 and 5 which arcs are in series. The gas expanding out of the cavity 4 produces a sheet kind of discharge as indicated at 10. This sheet discharge effect cannot be obtained by striking an arc between the electrodes 7 and 6 only, which would merely provide a normal narrow spark discharge. The spark plug 1 according to the invention thus produces a sheet discharge which provides for ionization of the hot gas expanding in and being ejected from the cavity 4 so producing a jet of plasma as indicated by arrow 'E'. The jet E then provides reliable combustion of a lean air/fuel mixture.

Because extensions 8 and 9 of the electrodes provide a sheet discharge, the spark plug gap has in effect been extended, but the voltage does not have to be increased to achieve combustion. Further, the spark for ionizing the gas is self-stabilizing because any tendency for the spark between electrodes 6 and 7 to be extinguished by the gas expanding out of the cavity 4 will tend to reduce the arc current, hence reducing the heat dissipation in the cavity 4. This will result in the gas expanding more slowly, reducing the tendency to extinguish the spark between electrodes 6 and 7 and so maintaining the sheet discharge 10 and full ionization of the gas. The net result is that the plasma jet E is maintained.

The plasma jet E can be produced with less than 100 mJ of energy in such a plug.

It will be understood that the spark plug shown in the drawing and above described may be modified. For example, the parts 8 and 9 may converge or may be substantially parallel.

Figure 5:
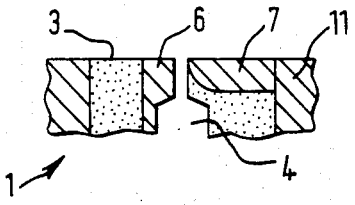
FIGS. 5 to 8 are schematic longitudinal sectional views respectively of different electrode configurations of spark plugs according to the invention.
Figure 6:
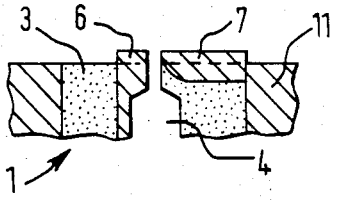
Figure 7:
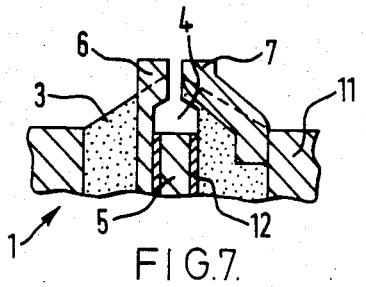

Referring now to FIGS. 5 to 8, different electrode configurations of spark plugs according to the invention are illustrated. In FIG. 5, electrodes 6 and 7 are flush with the surface 3 while in FIG. 6 there is shown electrodes 6 and 7 which extend outwardly of the surface 3. FIG. 7 shows electrodes in which the surface 3 itself is inclined to provide a generally frusto-conical configuration, the electrodes 6 and 7 being shaped to provide inclined electrodes which protrude above the surface 3 as in FIG. 4.

The motion of the jet in use in this embodiment draws fresh charge into the active region adjacent the plug thus encouraging mixing and improving combustion.

Figure 8:
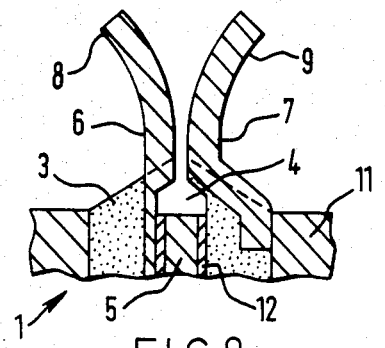

Similarly in FIG. 8, the electrodes 6 and 7 have extensions 8 and 9 respectively, the electrodes being laid on the surface of the insulator rather than being buried in it in order to maximize exposure of the fuel charge to the arc.

In FIGS. 5 to 8, there is shown a metal body 11 of the plug 1 with part of a screw thread by which the plug 1 may be screwed into an internal combustion engine. There is a central rod electrode 5 which is sheathed in a plastics material 12 such as polytetrafluorethylene (PTFE) except on the face exposed to the interior of the cavity 4.

Figure 9:
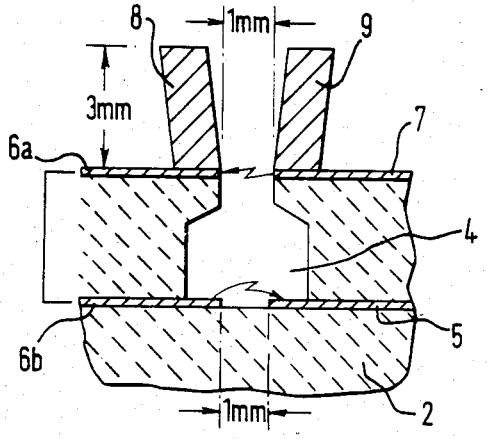
FIG. 9 is schematic longitudinal sectional view of a further spark plug according to the invention.

FIG. 9 shows another embodiment of spark plug electrode 6 comprising two parts 6A and 6B which are linked electrically as shown. The series arcs between electrodes 7-6A and 6B-5 are shown, there being provided a sheet discharge between extensions 8 and 9 in use.

In FIGS. 5 to 9, the exit from the cavity 4 is narrower than the cavity itself. In FIG. 9 the exit may be 1 mm in width, the volume of the cavity 4 being 28 $mm^3$, the extensions being 3 mm "long" (i.e., from the free ends of the extensions to the surface 3, measured vertically as viewed).

In the embodiments shown in FIGS. 4, 8 and 9, for example, the extensions 8 and 9 may be formed by wires secured to the electrodes 6,7, by a tube secured to those electrodes, or by integrally forming the electrodes to form the required shape of extension(s). These extensions modify the shape of the arc/plasma jet to provide a continuous combustion of lean mixtures. The net result stated another way, in each embodiment a stable sheet discharge is formed which can be generated at low energies and which can be used for the ignition of lean mixtures of fuel in internal combustion engines.

Figure 10:
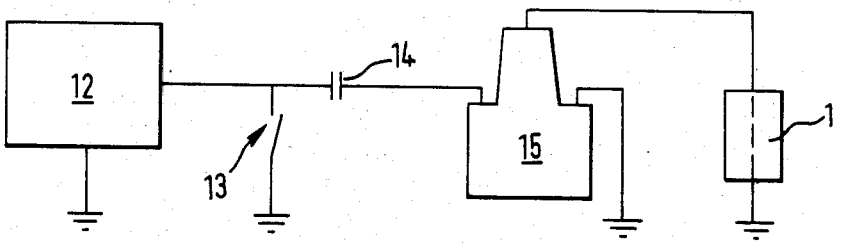
FIG. 10 is schematic lay-out of a driver unit for a spark plug according to the invention.

FIG. 10 shows schematically a driver unit which can be used for driving a spark plug 1 embodying the invention.

The plug 1 is connected in a circuit including a battery 12 (+350 V supply), an electronic switch 13, a capacitor 14 and ignition coil 15.

The capacitor may have a capacitance of 1 $\mu$F.

The stored energy is then:

$$(CV^2)/2 = 60 \text{ mJ}$$

Using such a circuit with the switch closed for 0.5 m seconds, a peak spark current of about 75 mA falling exponentially to 20 mA peak at the end of the 0.5 ms period is achieved, the circuit "ringing" at about 4 KHZ.

The volume of the cavity 4 may be varied by making the position of the electrode 5 relative to the body 2 adjustable.

The space between facing surfaces of electrodes 6 and 7 may have a width/diameter of 0.508 mm which is also equivalent to the lateral extent of the cavity. The distance between the base (as viewed) of the electrode 6 and the top (as viewed) of the electrode 5 may be 0.381 mm.

It will be understood that a spark plug embodying the invention has many applications, and is not just for internal combustion engines, for example:

1. Other types of engine where the plug could be used are:
   (a) Gas Turbines
   (b) Gas Engines
   (c) Spark Arrested Diesels
   (d) Any other type of engine requiring or benefitting from a spark to initiate combustion.
2. The plug could be used as an ignitor in static applications:
   (a) Boilers
   (b) Heaters
   (c) Process Plant
   (d) Gas Jets
   (e) Blow Lamps
   (f) Torches.
3. The plug could also be used anywhere a pulsed source of ions is suitable:
   (a) Cleaning by Ion Bombardment
   (b) Surface Treatment
   (c) Inducing Chemical Changes in Surfaces
   (d) Triggering Electrical Discharges
   (e) Displays
   (f) Inducing Chemical Reactions.

In every embodiment, the use of two arcs in series utilizes the available energy more efficiently, a larger proportion thereof being dissipated in the arcs and less in the (external) driving circuitry.

I claim:

1. A spark plug including means defining a spark cavity having a base, sidewalls, and an exit opening providing a path of escape from the cavity for gases expanding therein, first electrode means defining a first spark gap across an interior portion of said cavity, and second electrode means defining a second spark gap extending across said exit opening, said second electrode means being positioned relative to said first electrode means such that gases escaping from the cavity interior along said path of escape as a result of a spark across said first spark gap must traverse said second spark gap, said second electrode means further being in series with said first electrode means, whereby any tendency of said escaping gases to reduce spark current at said second spark gap causes a similar spark current reduction at said first spark gap, thereby reducing the flow of escaping gases and stabilizing the spark currents at said first and second spark gaps.

2. A spark plug according to claim 1, wherein said first electrode means comprises a pair of first electrode members including an insulated electrode member situated proximate the base of said cavity and an insulated electrode member situated proximate a sidewall of said cavity, and wherein said second electrode means comprises a pair of second electrode members including an insulated electrode member positioned to one side of said exit opening and an additional electrode member spaced across said exit opening from that insulated electrode member.

3. A spark plug according to claim 2, wherein said second electrode members are flush with a surface of the plug.

4. A spark plug according to claim 2, wherein said second electrode members extend outwardly of a surface of the plug.

5. A spark plug according to claim 2, wherein said second electrode members have respective extensions projecting outwardly of a surface of the plug.

6. A spark plug according to claim 2, wherein said electrode member positioned proximate a sidewall of said cavity and said electrode member positioned to one side of said exit constitute portions of a single insulated electrode.

7. A spark plug according to claim 5, wherein said extensions comprise wires secured to the respective second electrode members.

8. A spark plug according to claim 5, wherein said extensions comprise tubular extension means secured to the respective second electrode members.

9. A spark plug according to claim 2, wherein the volume of the cavity is adjustable.

10. A spark plug according to claim 2, wherein said exit of said cavity is narrower in width than the interior of said cavity.

11. A spark plug according to any of claims 5 to 8, wherein said extensions have respective free ends spaced further apart than ends of said extensions adjacent the surface of the plug.

12. A spark plug according to any of claims 3 to 8, wherein said surface is of generally frusto-conical configuration.

* * * * *